United States Patent [19]

Repp

[11] 4,084,762

[45] Apr. 18, 1978

[54] ARRANGEMENT FOR THE AUTOMATICALLY RELEASABLE AFFIXATION OF REELS ON ROTATABLE HUBS

[75] Inventor: Arno Repp, Darmstadt, Germany

[73] Assignee: Robert Bosch GmbH, Stuttgart, Germany

[21] Appl. No.: 778,888

[22] Filed: Mar. 18, 1977

[30] Foreign Application Priority Data

Mar. 20, 1976 Germany ..... 2612019

[51] Int. Cl.[2] ..... B65H 17/02

[52] U.S. Cl. ..... 242/68.3

[58] Field of Search ..... 242/68.3, 68.1, 68.2; 403/376

[56] References Cited

U.S. PATENT DOCUMENTS

| | | | |
|---|---|---|---|
| 2,213,777 | 9/1940 | Wittel | 242/68.3 |
| 2,882,078 | 4/1959 | MacDonald | 242/68.3 X |
| 2,983,460 | 5/1961 | Wright | 242/68.3 |
| 3,379,388 | 4/1968 | Gruczelak | 242/68.3 |
| 3,944,153 | 3/1976 | Linkev | 242/68.3 |

*Primary Examiner*—Edward J. McCarthy
*Attorney, Agent, or Firm*—Ernest F. Marmorek

[57] ABSTRACT

An arrangement for the automatically releasable mounting of reels on rotatable hubs including an equidistant arrangement of several spring-mounted gripping levers on the periphery of a take-up drum, the external diameter of which corresponds to the borehole diameter of the reel, and in which the gripping levers extend parallel to the axis of rotation of the take-up drum: two spring arrangements close to each extremity of each gripping lever are prestressed radially in outward direction, each lever being approximately in the center rotatably supported by an adjusting screw in such a manner that on mounting of the reel, the end of the gripping lever which is nearest to the reel is travelled over first, and upon pushing the reel further on, the second end is travelled over, whereupon the first end is tilted upwardly into engagement with a locking surface of the reel.

11 Claims, 3 Drawing Figures

ARRANGEMENT FOR THE AUTOMATICALLY RELEASABLE AFFIXATION OF REELS ON ROTATABLE HUBS

FIELD OF THE INVENTION

The present invention relates to an arrangement for the automatically releasable mounting of reels on rotatable naves hubs.

BACKGROUND OF THE INVENTION

Different construction principles have become known for the releasable mounting on rotatable reel supports or hubs of reels for the uptake of tape-like information carriers. It is the aim of a series of known arrangements to achieve this type of mounting in an automatic manner, that is to say, without actuation of a control element or without making use of any auxiliary force. Such types of arrangements are easy to handle and reduce the risk of damage to the tape, which risk, in the presence of a separate actuating element, is always present due to the fact that the actuation of the latter can be overlooked and that the reel, which is disposed only loosely on the hub, may then give rise to slacknesses in the tape.

An arrangement of the initially mentioned type is known, for example, from the German DT-AS no. 19 12 076. In that publication, a stud is provided with two adjacently disposed, shallow annular slots, between which a flexible, tensioned ring is rolled back and forth when the tape reel is being pushed on, or being removed. The mutual distances of the annular slots and the distances between the annular slots from the reel-supports, as well as the cross-sectional circumference of the flexible ring are selected in such a manner that the pushed-on reel is pressed in a resilient manner against the reel-support. However, in the case of this arrangement, it can hardly be avoided, that after a relatively large number of mountings, the flexible ring is twisted in itself, so that, under certain circumstances, the reel is not pressed with sufficient force over its entire periphery against the reel-support. Furthermore, also in view of the tolerances during the manufacture of flexible rings, as well as in view of aging processes, wear and tear and temperature influences, there is no guarantee that the operating behavior of this arrangement remains sufficiently uniform and reliable over relatively longer periods of time.

In the case of another arrangement known from the DT-AS no. 19 14 476, the hub is divided into an inner and outer hub-part. The inner hub-part includes a truncated cone surface on which, during the inward displacement of the outer hub-part, a number of pins, which are uniformly distributed along the periphery of the outer hub part, and which radially slide in the cylinder wall, are moved outwardly. Into an annular ring slot at the exterior of the periphery of the exterior hub part, a flexible ring is inserted, which is frictionally connected with the tape-reel. A snap-spring holds the two hub parts together in their end positions, and connects them in a torsion-resistant manner. Although this arrangement eliminates an essential disadvantage of the above described arrangement, namely the tendency of the flexible ring to become twisted, its proper functioning likewise depends on the characteristics of the ring, such as flexibility and form stability, which characteristics can become lost. Furthermore, the reel is not pressed in a resilient manner against the reel support, so that it can wobble.

Furthermore, an arrangement for an automatic assurance of the proper mounting of a reel used in conjunction with recording tapes has become known (DT-AS no. 21 58 862), in the case of which rocker arms, when mounting the reel on top of the reel-support, rock over from a first stable take-up position, while overcoming a dead center, to a second stable holding position. However, the claw-like construction of the rocker arms requires a particular construction of the reel take-up bore, so that the standard tape reels with even boreholes, which are available in large quantities, cannot be used with this arrangement. Furthermore, special precautions have to be taken for the accurate transfer of the rotational momentum from the reel-support to the reel. Moreover, the known arrangement has a heavy intrinsic weight, which is particularly disadvantageous in cases of portable instruments.

SUMMARY OF THE INVENTION

With the above in view, it is the object of the present invention to provide a mounting arrangement for a tape-reel on a winding shaft, which arrangement combines great operating reliability with light weight without the necessity of actuating additional control elements.

It is a further object of the present invention to enable the use of standard reels with smooth take-up boreholes and their mounting and removal from the winding shaft without any particular strain.

It is still a further object of the present invention to provide a mounting arrangement for tape-reels in coaxial arrangement, for example, for the purpose of economy of space and weight in cases of portable tape instruments.

The foregoing and other objects of the present invention will become apparent as the following description proceeds and features of novelty which characterize the invention will be pointed out in particularity in the claims affixed to, and forming a part of this specification.

BRIEF DESCRIPTION OF THE DRAWINGS

Also the invention will become more readily apparent from the following description of preferred embodiments thereof shown, by way of example, in the accompanying drawings, in which.

DESCRIPTION OF THE PREFERRED EMBODIMENTS

Figure 1:
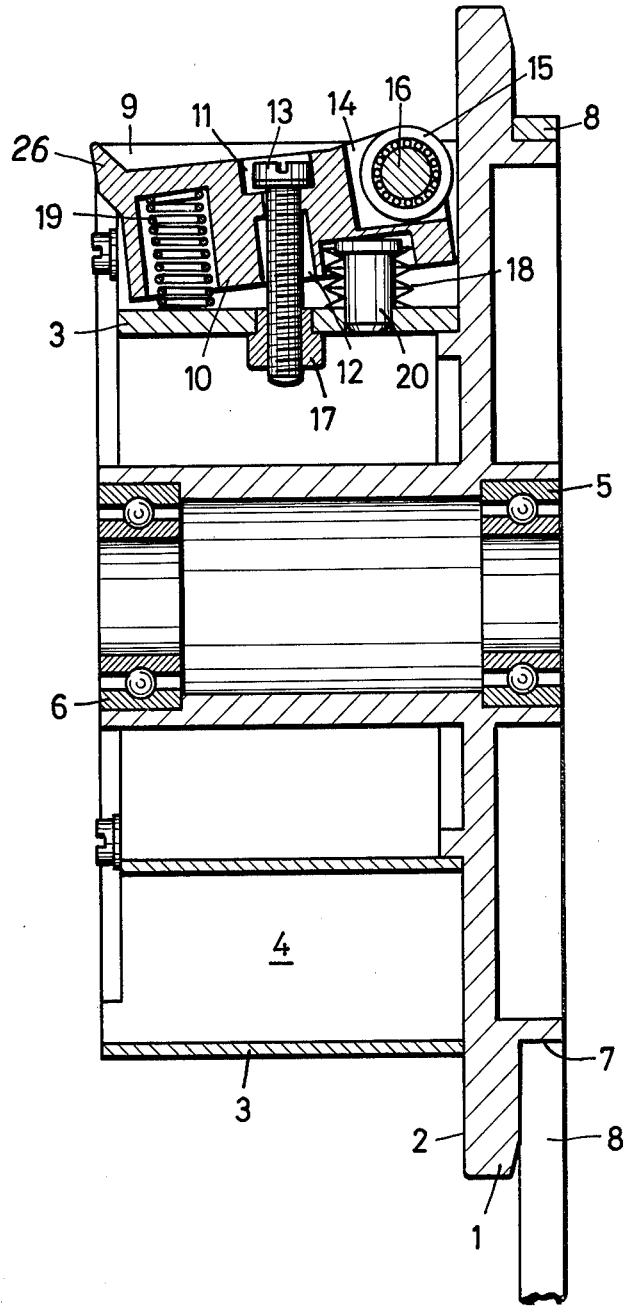
FIG. 1 shows the mounting arrangment according to the invention in form of a longitudinal section.

The mounting arrangement according to FIG. 1 includes a rotationally symmetrical hub member 1, on face surface 2 of which a take-up or clamping ring 3 is attached by mounting means not illustrated here. For example, this mounting can take place by means of screws or also through gluing. For the purpose of weight reduction, the hub member 1 and the clamping ring 3 are made of light metal, and numerous boreholes 4 are made in the clamping ring, namely distributed over the periphery of the same. By means of the ball bearings 5, 6, the entire arrangement is rotatably mounted on a shaft, which is not illustrated here. The entire arrangement is set into motion by means of a belt 8, which is disposed within a ring-shaped groove 7. The groove 7 may have the shape of a V-belt pulley profile, and the belt 8 may be a V-belt.

Figure 2:
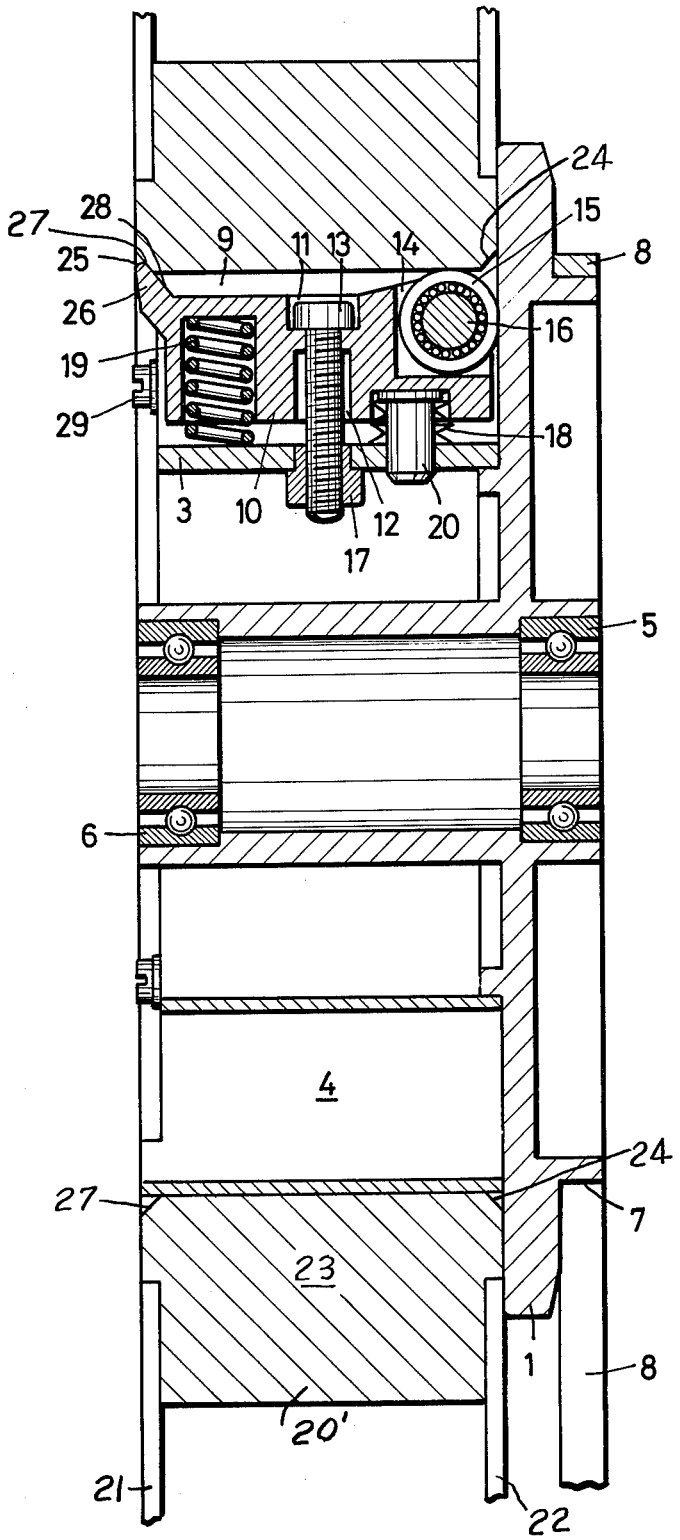
FIG. 2 shows the same mounting arrangement in the same manner of representation, only with a mounted tape-reel.

The peripheral surface of the clamping ring 3 has at least three grooves 9, of which only one can be seen in on the cross-sectional views of FIGS. 1 and 2, the grooves being spaced in equidistant arrangement for the take-up of the gripping (or chuck) levers 10. In the center, each gripping lever 10 has displays a stepped borehole 11 which communicates with a bore 12 also formed in the lever 10 in order to insure a trouble free tilting of the gripping lever 10. A socket-head screw 13 is inserted in the borehole with adequate play, so that the gripping lever 10 can execute a limited tilting movement in the direction of the plane of the drawing. The socket-head screw 13 is affixed to the clamping ring 3 by means of a press-locked nut 17 and is secured with floating screw locking means. In a perpendicular direction to the drawing plane, the gripping lever 10 is guided by the walls defining the groove 9. In a recess 14 of the gripping lever 10 a sleeve 15 mounted on a pin bearing is arranged on a shaft 16. The position of the gripping lever 10 is determined by means of two spring elements 18 and 19, and by means of the screw 13. The spring element 18, includes a set of cup-springs and which are guided by means of a guide-pin 20 which is movably mounted in the clamping ring 3; the spring 19 disposed in another recess of the lever 10 is a compression spring. The tilting movement of the gripping lever 10 is limited by the lower rim of borehole 12. By a further rotation of the screw 13 into or out of the nut 17, the protrusion of the pin sleeve 15 above the peripheral surface of the clamping ring 3, as well as the location of the nose portion 26 of the gripping lever 10 can be adjusted.

The mode of operation of the mounting arrangement will be explained in more detail with the aid of FIG. 2, which shows the same arrangement as FIG. 1, however, with a mounted tape-reel. The same reference symbols are used in FIG. 2 for parts which correspond to those shown in FIG. 1.

When mounting the tape-reel 23 which consists of a reel-hub 20' and of the two reel flanges 21, 22, the reel hub 20' is first of all made to slide over the outer circumference of the clamping ring 3, until an edge 24 partly defining a borehole in the reel abuts against the pin-bearing sleeve 15. The height of protrusion of the pin sleeve 15 above the gripping lever 10 has previously been adjusted in such a manner by means of the screw 13, that the edge 24 of the reel-hub 20 can press it down without any difficulty, without the gripping lever 10 coming in contact with the edge 24. When travelling over the pin sleeve 15, the latter is depressed radially with respect to the direction of the axis of rotation of the mounting arrangement, until the outermost point of the pin sleeve 15 is flush with the outer circumference of the clamping ring 3. During this motion, the gripping lever 10 is simultaneously tilted so that a tip 25 of the nose portion 26 of the gripping lever 10 then abuts the inner periphery of the reel 23 defined by its hub bore. The compression coil spring 19 is then slightly compressed, but the cup-spring-set 18 is compressed to a greater extent depending on the respective distances of the spring 18 and the spring set 19 from the virtual or momentary point of rotation of the tip 25. As the reel 23 further along is made to slide from a non-illustrated position to the left of the position occupied by the reel 23 in FIG. 21, the tip 25 finally begins to make contact with the edge 27 partly defining the borehole of the reel 23. From the initial contact point of the tip 25 of the nose portion 26 of the gripping lever 10 with the lowermost portion of the edge 27, the tip 25 moves in an upward direction until it abuts the edge 27 as the tape reel flange 22 travelling towards the right, makes contact with the face surface 2 of the hub member 1. The force of the compression spring 19 and the set of cup-springs 18 cause the tip 25 to abut against the edge 27, as the tape-reel 23 is simultaneously acted upon by a forward-thrust component in the direction of the stop-face 2, until it comes to rest there. The inclined plane 28 of the nose portion 28 thereby steadily exerts a force on the tape-reel 23, and thus retains it in the end position in a resilient manner. The trouble free transfer of the necessary momentum of rotation from the mounting arrangement to the tape-reel 23 takes place through the force locking of the pin sleeve 15 with the inner walls of the tape reel 23, defining its bore. The tape-reel 23 may be removed after use simply by a lifting motion in opposition to the resilient resistance of the inclined plane 28, until the tip 25 of the nose 26 is disposed in the reel-borehole. The tape reel 23 is then very easily removed as a result of the rolling friction of the pin bearing sleeve 15 in the borehole of the tape-reel 23. After the pin sleeve 15 has emerged from the reel-borehole, the gripping levers 10 return to the starting position indicated in FIG. 1, and the reel 23 can be removed without any further difficulty. The heads of screws 29 serve thereby as travel-limit for the gripping levers 10.

Figure 3:
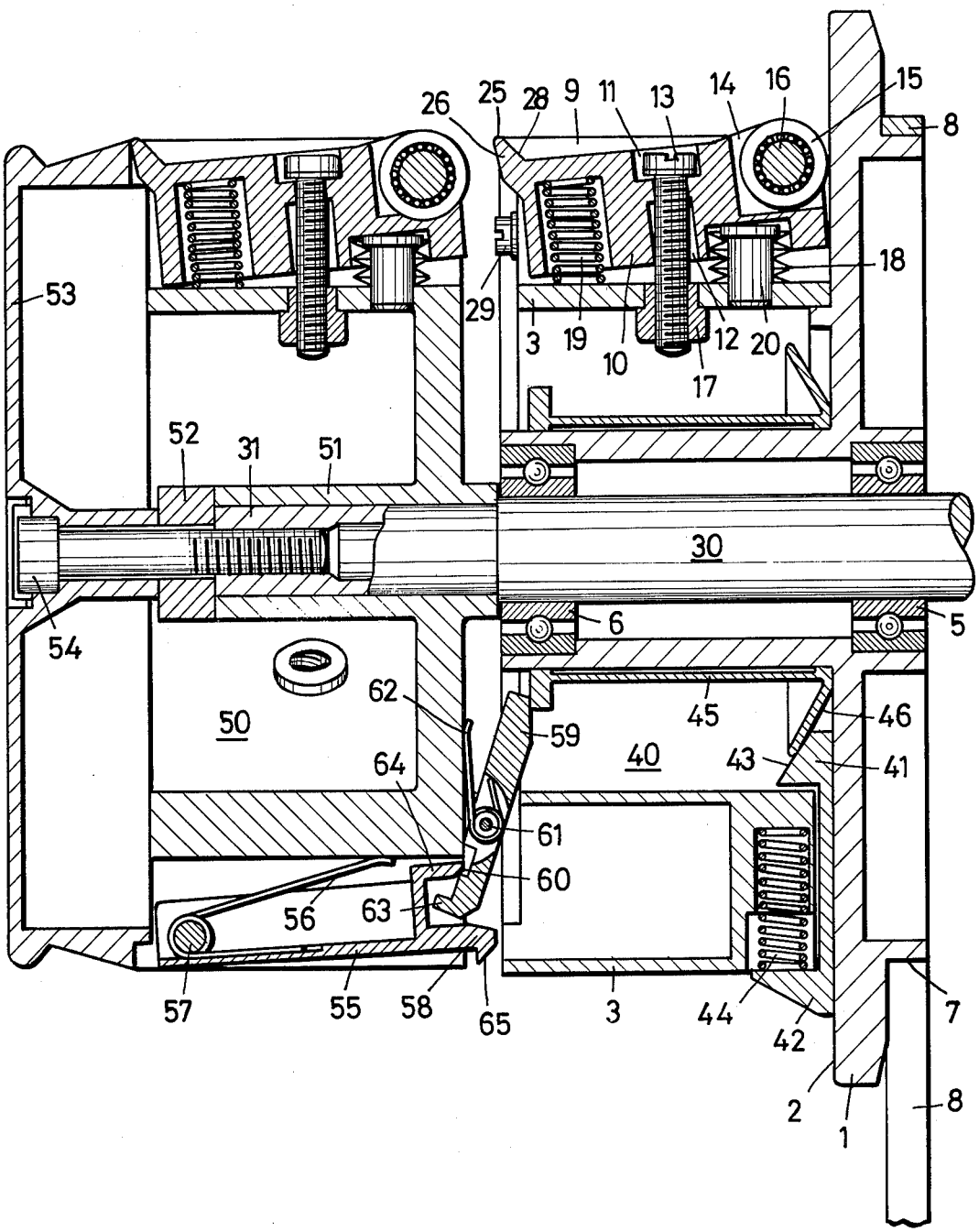
FIG. 3 shows another exemplified embodiment of the invention in coaxial arrangement, likewise in a longitudinal section.

FIG. 3 shows two-mounting arrangements according to the invention for use in a magnetic tape instrument having a coaxial arrangement of the tape-reels. In the techniques used for the magnetic storage of widebond signals, in particular of video-signals, instruments are used increasingly in which the magnetic tape is wound around the scanning-cylinder in a helical manner. The inlet and outlet of the magnetic tape are displaced with respect to one another by approximately the width of the magnetic tape, as seen in a longitudinal direction of the scanning cylinder. Accordingly, a vertical displacement of the tape guiding elements results upstream and downstream of the scanning device, which displacement can be made use of in the case of portable instruments so as to provide a space-saving, and weight-saving form of construction with coaxially arranged tape-reels. In particular, in cases of instrument-systems having tape storage reels arranged in a common cassette, a convenient solution is provided permitting easy handling of the system.

Parts having the numerals shown in FIGS. 1 and 2, have the same function in FIG. 3. As far as the complete arrangement is concerned, the following differences in construction and in the mode of action result:

The mounting arrangement 40, which is rotatably mounted by means of the ball bearings 5,6 on a central drive shaft 30, includes close to the stop-face 2 three wedge-shaped pushers 41 which are displaced by 120° with respect to one another and arranged in one radial groove each of the clamping ring 3. At its outer extremity, each pusher 41 includes a wedge surface 43 for engagement with a tubular slider 45. The tubular slider 45 is retained in the illustrated starting position by means of non-illustrated springs, and by a compression spring 44 shown in its extended position. The mounting arrangement 50 differs from the earlier described embodiment by being connected for rotation to the driving shaft 30. For this purpose, the shaft-stem 31 and the hub 51 are similarly shaped, for example, grooved, and both parts are connected to one another by means of a disc 52, with the disc 52 being attached to the driving shaft 30, together with a cover 53, by means of a screw 54.

Furthermore, the stop-face 2 of the arrangement shown in FIGS. 1 and 2 is replaced by a movable stop-lever 55 so that, when mounting the first tape-reel, the latter can slide over the arrangement 50 and is made to abut against the mounting arrangement 40. When sliding a tape reel onto the mounting arrangement, according to FIG. 3, the tape reel first of all slides over the arrangement 50. Although the gripping levers 10 are thereby pressed downwardly in the manner already described in rotation to FIGS. 1 and 2, the levers 10 will again return to the illustrated starting position after the tape-reel has passed over the left-side pin sleeve 15. When the annular edge 24 (FIG. 2) of the tape reel impinges upon the wedge surface 42, the wedge-shaped pusher 41 moves radially in an inward direction in opposition to the force of the compression spring 44. This causes the inner wedge 43 to slide along the truncated cone surface 46 of the tubular slider 45, and the tubular slider 45 having a face 66 disposed opposite the surface 46, is moved to the left towards the mounting arrangement 50 for engagement of the face 66 with one end of an intermediate or double lever 59.

The stop-lever 55 of the mounting arrangement 50 is acted on by an initial biasing force of the hairpin spring 56 which, similarly as the stop-lever 55, is mounted on a shaft 57. This initial biasing force urges the stop-lever 55 to rotate so as in turn to urge in such a manner, that the stop-catch 58 to move radially outwardly beyond the peripheral area of arrangement 50. Due to the engagement of the stop-lever 55 with the intermediate lever 59 at a stop notch 60, the stop-catch 58 remains within the peripheral area. The intermediate or double lever 59 is mounted on a shaft 61, and the hairpin spring 62 which is wound around the shaft 61 retains the intermediate lever 59 in such a manner, that the stop-lever 55 comes to rest in the stop-notch 60 of the intermediate lever 59.

During the mounting of the first tape-reel, the movement of the tubular slider 45 brings about a slight rotation of the intermediate lever 59. The engagement of the two levers 55,59 is released. The stop-lever 55 moves radially in outward direction, until the stopfinger 64 impinges against the stop-catch 63. The stop-catch 58 of the stop-lever 55 then projects radially beyond the peripheral area of the mounting arrangement 50, and serves as stop for the second tape-reel to be mounted on the left-hand side of the mounting arrangement.

When removing tape-reels, one first of all removes the tape reel mounted on the left hand side of the mechanism shown in FIG. 3. When lifting off the second reel mounted on the arrangement 40, the edge 27 of the tape-reel (best seen in FIG. 2) pushes against the slanted surface 65 of the stop-lug 58. As already, following the removal of the reel tape from the stop-face 2, the wedge-shaped pusher 41 acted on by the force of the spring 44, the tubular-slider 45, and other non-illustrated springs return to their starting or rest positions, thereby easing the effect on the lever 59, the edge 27 of the tape reel may push the stop-lever 55 so far inwardly, that the intermediate lever 59 comes to rest at the stop notch 60, and thus retains or arrests the stop-lever 55 from any further radially inward movement. After the complete lifting-off of the tape-reels, the mounting arrangement is again ready to take-up a set of new tape-reels.

I wish it to be understood that I do not desire to be limited to the exact details of construction shown and described, for obvious modifications will occur to a person skilled in the art.

Having thus described the invention, what I claim as new and desired to be secured by Letters Patent, is as follows:

1. Arrangement for the releasable mounting of a reel on a rotatable hub, comprising a take-up means having an external diameter corresponding to the borehole diameter of the reel, a plurality of gripping lever means resiliently mounted within said take-up means at predetermined distances between each other, said gripping lever means extending parallel to the axis of rotation of said take-up means, a pair of spring means each being arranged adjacent the opposite extremities of said gripping lever means and being biased radially in outward direction, and means supporting said gripping lever means approximately at the center portion thereof in a rotatable manner, whereby during mounting of the reel, an end of the gripping lever means facing away from said hub is travelled over and when pushing the reel further on over said gripping means, a second end thereof is travelled over and the first end travelled over is forced radially upward in locking engagement with the reel.

2. Arrangement according to claim 1, wherein the first extremity of the gripping lever means which is completely travelled over by the reel comprises a slanted surface at the side facing of the reel, said slanted surface being directed toward a stop-face of the mounting arrangement.

3. Arrangement according to claim 1, wherein means are provided for adjusting the radial path of rotation of said gripping lever means.

4. Arrangement according to claim 1, including means for the coaxial mounting of a pair of reels, and a reel-stop for one of the reels comprising a movably arranged stop-lever, and a stop-face for the other of said reels.

5. Arrangement according to claim 4, wherein means are provided for translating said stop-lever from a first rest-position to a second operating position after said first reel has been pushed over said stop-lever.

6. Arrangement according to claim 4, wherein there is provided at least one radially movable pusher-arrangement adjacent said stop-face, said pusher-arrangement at a radially outer end thereof including a slanted surface for engagement with an edge of the other of the reels partially defining a borehole therein, and further including a slider for exerting a force in an axial direction of the mounting arrangement and having a front-face slanted for engagement with said pusher-arrangement and a second front-face, and further comprising a double lever for said second front face to exert a force on said double lever, whereby, pushing on the first reel, the radial displacement of said pusher-arrangement is transferred onto the double lever, whereupon said double lever moves said stop-lever from a rest-position into an operating position.

7. Arrangement according to claim 4, wherein said stop-lever comprises a stop-lug having a surface facing said stop-face, said surface being formed as a slanted surface for interacting with another edge of the reel.

8. Arrangement according to claim 6, wherein said double lever comprises a first stop-face and a second stop-face and a sliding surface therebetween having a degree of inclination whereby in said operating position of said stop-lever, said double lever becomes lifted off from said slider.

9. Arrangement according to claim 1, wherein the supporting means includes an adjusting screw.

10. Arrangement according to claim 1, wherein said end of said gripping lever means facing away from said hub comprises a nose portion adapted to positively engage and lock said reel on said take-up means when said reel has travelled over said nose portion.

11. Arrangement as claimed in claim 1, wherein there are provided three gripping lever means distributed over said take-up means at 120° apart from each other and locking said reel in positive engagement for rotation with said take-up means.

* * * * *